United States Patent [19]

Supik

[11] 4,372,719

[45] Feb. 8, 1983

[54] ANNEALING OF END RIM

[75] Inventor: Helmuth Supik, Sarstedt, Fed. Rep. of Germany

[73] Assignee: The Continental Group, Inc., Stamford, Conn.

[21] Appl. No.: 226,988

[22] Filed: Jan. 21, 1981

[51] Int. Cl.[3] ..... B21D 51/00

[52] U.S. Cl. ..... 413/9; 72/342; 72/364; 413/18

[58] Field of Search ..... 72/364, 342; 413/9, 413/18, 58, 59

[56] References Cited

U.S. PATENT DOCUMENTS

| | | | |
|---|---|---|---|
| 3,295,486 | 1/1967 | Simons et al. | 413/9 |
| 3,344,093 | 9/1967 | Strickman | 413/9 |
| 3,872,704 | 3/1975 | Ohya et al. | 72/364 |
| 3,886,881 | 6/1975 | Pearce et al. | 413/18 X |
| 4,326,896 | 4/1982 | Lyu | 413/18 X |

*Primary Examiner*—Leon Gilden

*Attorney, Agent, or Firm*—Charles E. Brown

[57] ABSTRACT

A method of annealing the flanges of double seamed end panels to obtain an effective seal and apparatus therefor.

9 Claims, 3 Drawing Figures

ANNEALING OF END RIM

BACKGROUND OF THE INVENTION

Figure 1:
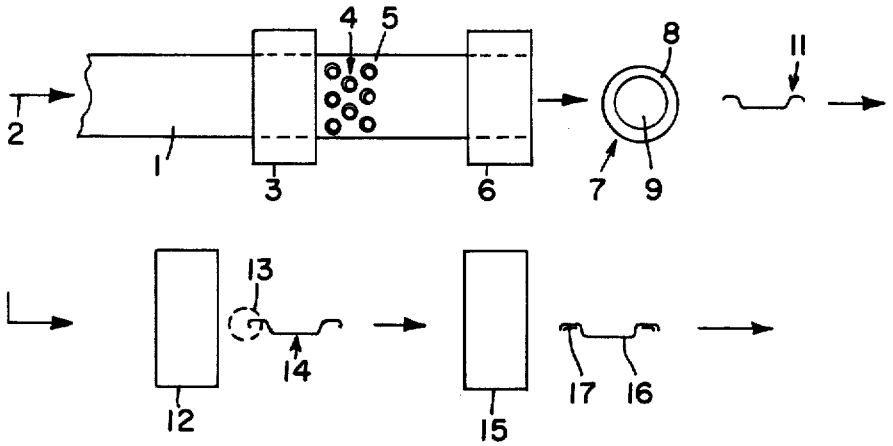

The invention relates to a process and to a device for manufacturing seamed ends, especially tear open ends from hard-to-deform ferrous sheet metal in which the lacquer coated and with a rubber coated flange provided end, made of sheet metal bands of sheet metal plates is stamped and deformed.

End members of this kind are connected with their curled edge to a container (can body) by a double folded seam seal. To improve the sealing, rubber or elastomer bands are provided in the area of the edge of the end and are compressed between the container can body edge flange and the flange of the end in a double folded seam. Such ends are produced of sheet metal. Ferrous sheet metal is used in great amounts for this purpose which is provided in the form, for example, of tin coated sheet metal plates or sheet metal bands covered with a lacquer coat and with the annular rubber or elastomer coating according to a predetermined pattern and stamped then in the shape of ends and deformed. A score line or a prestamped opening may be provided at this time if easily to be opened cans are being produced.

On the surface of the end, the end flange is connected over a core bevel that is basically cylindrical and over an inner radius of a gage plate in the flange area proper and passes over a core wall curvature at the level of the end surface. The outer curled-on flange area is generally designated as end hook. The rubber coating is applied in the area of the end hook up to the inner radius of the gage ring.

Since the sheet metal is submitted during the formation of the end flange to an enormous deformation work, only respectively easily deformable expensive sheet metal could be applied heretofore for the fabrication of ferrous sheet metal ends. Less expensive sheet metal, for example, so called DR-sheet metal with an omitted last intermediate annealing were practically not used heretofore for the fabrication of ends of a thickness of less than 0.25 mm, since such hard-to-deform sheet metal that lies within the pricewise interesting range, tend to form flanged on the end hook. Such flange forming, however, leads to leakages within the double seam area. On the other hand, such sheet metal could offer special advantages in the process of fabrication of ends, not only in the area of cost savings. Such hard-to-deform sheet metal have thus better elasticity in preserve can ends, as well as higher nose forming strength, especially in ends for beverage cans.

It is the task of the invention to offer a process and a device with the help of which even the application of costs saving but hard-to-deform sheet metal can be used for the fabrication of ends, especially in the area of thicknesses that are costwise interesting without losing the advantage of lower costs of these sheet metals as to the cost of conventional sheets and without having to fear that the ends will leak within the sealing at the folded seam.

This task is solved according to the invention by that the curled-up and not by lacquer coated flange of the ends is re-annealed before its rubber coating had been applied for a period lasting less than 2 seconds in an atmosphere of inert gas. It can be prevented by this that the lacquer coating is applied to the sheet metal according to a predetermined pattern so that, during the lacquer coating, annular clearances of lacquer are produced which correspond to the flange areas of the stamped-out sheet metal, while these flange areas will be powder coated after the annealing. However, the preferred proceeding is that the blanks of sheet metal are stamped and the ends are submitted to an annealing of the flanges without being lacquer-coated, whereafter the end is submitted to a lacquer coating, preferably in the form of a powder coating before the application of a rubber coat in the flange area.

The annealing of the flange area is preferred as limited to the area of the end hook. According to the thickness of the sheet and its type, the annealing can reach also up to the core bevel. The core bevel itself and core wall curvature should, however, as far as possible, be excepted. This goes also for the gage ring's inner radius. The re-annealing, especially, should reach only as far as the increased nose-forming strength of the applied sheet metal is exploited to its full extent in comparison with that of conventional sheet metal.

The new process can be applied for sheet metal ends of different nominal diameters, especially within a range of nominal diameters from 57 to 63 mm. The initial hardness of the sheet metal, related to the known designations of sheet metals can be greater or equal to hardnesses of sheet metals of the specification DR 8, DR 9 and DR 10, while the thicknesses are foreseen within the range between 0.1 mm and 0.3 mm, preferably within the range equal or less than 0.25 to 0.15 mm. The diameter, the hardness of the sheet metal and its thickness depend among others also on the application of the can that is provided with the end. Especially suitable is the end for sealing usual preserve cans, coffee cans, beer cans or other beverage cans, cans for mineral oil, etc.

The results of examinations was that the thus processed sheet metal ends can be sealed without forming folds and without any danger of leakages done perfectly on conventional machines with double seam sealing with the respective cans or containers.

Preferably slightly tin-coated fine sheets are used and the annealing temperatures of the period of annealing are selected so that the tin coat is fused within a short period of time, however, without evaportion or damaging of any kind and brought again to a hardening. According to the annealing in a ring inductor, according to the thickness of the material and the width of annealing, the time of annealing can vary. It should last for less than 0.1 sec, since otherwise a damage or destruction of the materials to be annealed is to be feared by occuring whirling streams. The times of annealing should preferably amount to an annealing width of 2 or 3 mm of the outermost end flange within the range from 0.02 to 0.06 seconds, related to the annealing of 1200 ends/min with a ring inductor of 20 kw (300 kHz). Should the entire end flange (of the gage ring radius exclusively) or of metal sheets of a greater thickness be annealed, a higher amount of energy, resp. a longer time of annealing is necessary.

Figure 2:
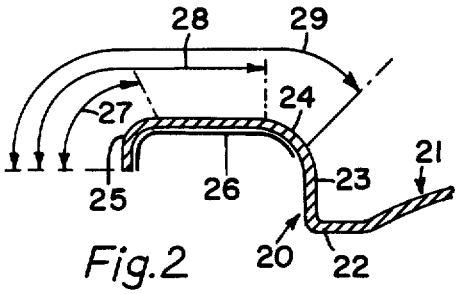
Figure 3:
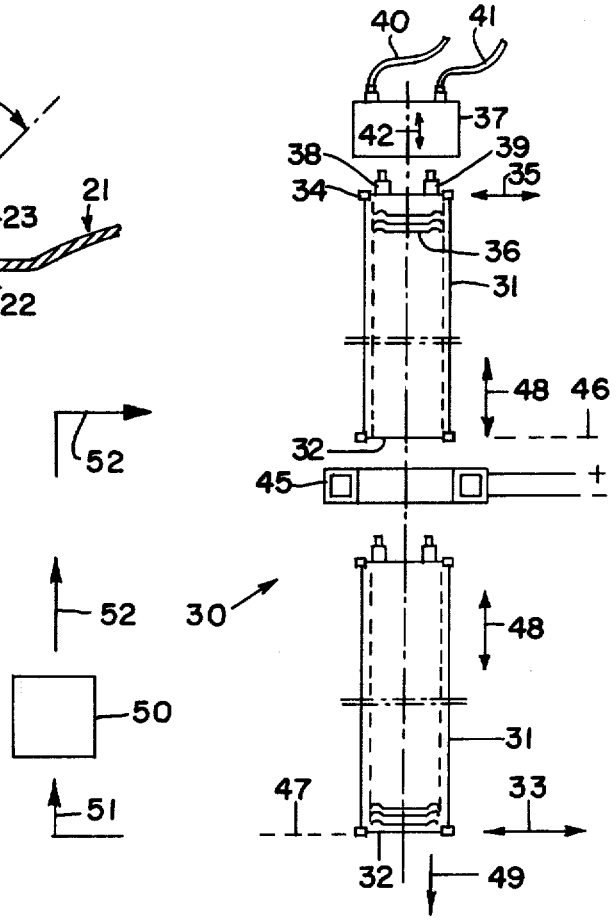

The invention is detailed in the schematic drawings which show:

FIG. 1 is a fabrication diagram for the production of ends according to the process of the invention, FIG. 2 is a section through the flange area of an end and, FIG. 3 is a side view of the diagram of a device for a loadwise (chargewise) annealing of non-lacquered raw ends.

DESCRIPTION OF THE INVENTION

In the diagram of manufacture according to FIG. 1, the process starts with a band-shaped or strip metal sheet 1 which is guided along the arrow 2 through several stations. A slightly tin coated metal sheet or strip of difficult deformation features may be considered.

In the first station 3, the metal sheet, for example, with the help of rollers, is provided with a coat of lacquer whereby this coat of lacquer 5 is applied according to a predetermined pattern in which clearances without lacquer remain in an annular or ring shape 4. The station 3, however, can be omitted when a lacquer-coating of the metal sheets is not foreseen in this stage of the production which is the preferred method of manufacturing in many cases.

The band of metal sheet runs then into a station 6 in which ends 7 are stamped from the band of metal sheet and are deformed. Such an end 7 is shown at the right side of the station 6 in a top view and in section. It is presumed that in this case, the middle end area 9 is provided with a coat of lacquer and surrounded by a marginal area 8 that has no lacquer. In case of the lacquer coating and drying station 3 being omitted, the end 7 is free of any coating of lacquer.

The thus deformed end with the deformed flange area 11 arrives then into a re-annealing area 12 in which the flange area is submitted to a re-annealing under conditions heretofore explained in detail. The thus treated end is shown at 14 in FIG. 1 where the re-annealed flange area is indicated at 13. The end arrives now into a station 15 in which the nonlacquer coated metal sheet of the end is submitted to a lacquer coating, especially to a powder coating, whereafter the usual rubber or elastomer band of sealing material or lining compound 17 is applied to the flange area. On ends on which the flange area only is not lacquer coated, it is possible to apply the lacquer in station 15, before the application of the material or lining compound 17 to an end 16, a subsequent lacquer coat.

The thus prepared end 16 is ready for its further application. When applied on a filled container or on a can, the flange area turns out to be, in spite of the application of a hard-to-deform ferrous metal sheet, sufficiently deformable so that the double seam sealing is reliable and the container can be produced with a reliable hermetic sealing.

FIG. 2 shows in cross-section and on a larger scale the flange area of a typical end 20. The center panel of the end is indicated by 21. This panel may have every desired deformation, for example, beads or impressions, score lines for enhancing the opening of the end or various easy opening closures.

A basically cylindrical (core bevel) 23 is attached to the end panel 21 by a chuck accommodating transition wall 22. The wall 23 passes over a gage ring radius 24 and merges into the flange proper that ends at its outer periphery in an end hook 25. The coating area for the later-to-be-applied rubber or elastomer coating is indicated at 26.

The re-annealing may be limited to the narrow area of the end hook 25 as is indicated by the arrow in the area 27. The re-annealing however, can equally extend to the marginal area between the end hook 25 and the gage ring's inner radius 24 as indicated by the arrow 28 in the area. The maximal annealing area should encompass all of the flange between the chuck wall 23 and, at most, include the inner radius of the gage ring 24, as is indicated by the arrow 29. The chuck wall 23 itself, but especially also the chuck wall radius 22, should be excluded from the re-annealing.

A preferred device for performing the re-annealing is shown in FIG. 3. The re-annealing must be performed in an atmosphere of inert gas for preventing oxidation and similar deterioration. It was proven that a charge-wise annealing is especially advantageous. The charges are formed preferably by a tower-like stack of, for example, of 100 end blanks 36. These charges are introduced into longitudinally extending hollow cylinder 31. The hollow cylinder can be manufactured of asbestos, coated by a plastic trademarked by the trademark "Teflon"-coated silica glass or similar. The tubular container 31 is hermetically sealed by end caps 32 and 34. In the upper position shown in FIG. 3 of the container 31, the upper end cap 34 of the container 31 can be removed sidewise along the arrow 35 in order to enable opening the container and permitting loading of the stack of ends 36. The loading can be, nevertheless, performed equally in another position of the container. The end 34 is applied after the filling of the container for hermetically sealing on the container 31. The end 34 shows appropriately two connections 38 and 39 which are automatically connected preferably by automatically closing valves upon lowering a cap 37 along the arrow 42. The valves have two connecting conduits 40 and 41. The connecting conduit 40 leads to an evacuating device by means of which the hermetically sealed container is first evacuated. Thereafter, an inert gas, for example nitrogen, is sucked by the vacuum through the connecting conduit 41 into the container. By lifting the cap 37, the connections 38, 39 are automatically closed. The container 31 is coaxially arranged with an annular inductor 45 which as can be seen is stationarily attached to a chassis and connected with a high frequency source of energy. The filled and inert-gas-filled container is lowered along the arrow 48 from the upper position in which the bottom 32 is placed in a plane 46 above the ring inductor 45. The lowering movement occurs appropriately at a uniform speed by which the effective period of annealing of the individual end flange is determined. When reaching the lowered position indicated for the bottom 32, the bottom 32 can be removed after a respective aeration of the container 31, and the charge can be emptied downward along the arrow 49. The emptying can occur also in another station. The emptied container 31 can be driven back by the switched-off ring inductor into the initial position 46 in an upward direction. However, it is possible to lead into circulation equally several containers 31, as this is indicated by the arrows 51,52. Each container 31 is moved hereby, after passing through the ring inductor 45, through at least one further station 50 in which the emptying and/or the refilling and sealing of the containers is realized in order to transfer the filled and sealed containers again into the upper position. In every case, the emptying is realized only after cooling off the filled workpieces 36 below the temperature at which scaling would form. This is secured by means of an appropriate setting of the timing period. Instead of the vertical plane, the movement of the container can follow also in a horizontal plane, for example, with the help of a revolving table through the ring inductor 45, oriented in a vertical plane.

I claim:

1. A process for manufacturing a can end from a hard-to-deform ferrous metal wherein said can end is of the type including a chuck wall, a radially extending seaming flange and an end hook, said process comprising the steps of stamping the can end from a hard-to-deform ferrous metal strip, annealing the area of said flange in an inert atmosphere for a period of time less than two seconds, and thereafter applying to said flange a band of elastomeric sealing material.

2. A process according to claim 1 wherein the annular annealing zone is defined by an inductive annealing device.

3. A process according to claim 1 wherein said annealing of the flange area is effected by induction heating.

4. A process according to claim 1, wherein the can end is enamel coated by the strip being coated before the stamping out of the can end and the formation of the annular flange.

5. A process according to claim 1, wherein the can end stamped from an uncoated metal strip and is coated by a powder coating only after annealing the flange and prior to application of the band of elastomeric material.

6. A process according to one of claims 4, 5 and 1, characterized by the metal being a finely tin-coated thin sheet of a thickness ranging from 0.1 to 0.3 mm, preferably between 0.15 and 0.25 mm.

7. A process according to claim 1, wherein the annealing of the can end is limited to the flange area of the can end and extends between the transition of the flange with the chuck wall at its inner edge and at its outer edge to the end hook.

8. A process according to claim 1 wherein by the can end being arranged equiaxially to an annular annealing zone and being passed along the axis through the annealing zone at a uniform speed.

9. A process according to claim 8, characterized by a plurality of can ends being arranged in a tower-like stack and being placed within an enclosure, and the enclosure being evacuated, filled with an inert gas and then continuously run through the annular annealing zone whereby the speed of the enclosure is adjusted so that the flange area of each can end is subjected to an annealing period of less than 0.1 second.

* * * * *